US011479458B1

(12) United States Patent
Miniello et al.

(10) Patent No.: US 11,479,458 B1
(45) Date of Patent: Oct. 25, 2022

(54) SYSTEM AND APPARATUS FOR AUTONOMOUSLY FUELING AN UNMANNED SURFACE VEHICLE

(71) Applicant: United States of America as Represented by the Secretary of the Navy, Arlington, VA (US)

(72) Inventors: Nikko Miniello, Virginia Beach, VA (US); John Phillips, Virginia Beach, VA (US); David C. Colburn, Jr., Virginia Beach, VA (US); Lawrence Michelon, Norfolk, VA (US); Gregory Rackley, Virginia Beach, VA (US); Danny Pineda, Rockville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/996,634

(22) Filed: Aug. 18, 2020

(51) Int. Cl.
*B67D 7/04* (2010.01)
*B67D 7/40* (2010.01)
*B65H 75/44* (2006.01)

(52) U.S. Cl.
CPC ..... *B67D 7/0401* (2013.01); *B65H 75/4402* (2013.01); *B65H 75/4478* (2013.01); *B67D 7/40* (2013.01); *B67D 2007/0417* (2013.01); *B67D 2007/0467* (2013.01)

(58) Field of Classification Search
CPC ..... B67D 7/0401; B67D 7/40; B67D 2007/0403–0474; B63B 27/34; B65H 75/4478
See application file for complete search history.

(56) References Cited

U.S. PATENT DOCUMENTS 4,408,943 A * 10/1983 McTamaney ..... B63B 27/24 114/74 R
4,762,016 A * 8/1988 Stoughton ..... B25J 9/04 414/680
5,154,132 A * 10/1992 Brushaber ..... E02B 3/24 114/230.11
6,604,711 B1 * 8/2003 Stevens ..... B64C 39/024 244/135 A
8,225,735 B1 7/2012 Galway
8,356,567 B1 * 1/2013 Gaston ..... B63B 21/58 114/242
8,568,076 B1 10/2013 Harris et al.
8,991,447 B1 3/2015 Petersen
9,803,787 B2 * 10/2017 Scott ..... F16L 37/004

* cited by examiner

*Primary Examiner* — Andrew D Stclair
(74) *Attorney, Agent, or Firm* — Dave Ghatt; Charles D. Buskey

(57) ABSTRACT

A system and apparatus for autonomously fueling a surface water vessel such as an unmanned surface vehicles (USV). A fueling system is secured to the dockside of a land secured or waterborne fueling station. The fueling system has a hose reel, a hose pusher and mooring whip for extending the hose out of the water for access to the surface water vessel. The vessel is equipped with an actuated arm that pivots between a closed position and an open position to capture the hose and connect the nozzle of the hose to the fuel tank of the vessel. The fuel tank has an interface with a mounting plate, nozzle interface and electromagnets that pull, positively locate, and hold the nozzle into the nozzle interface to access the fuel tank and to fuel the vessel.

3 Claims, 6 Drawing Sheets

SYSTEM AND APPARATUS FOR AUTONOMOUSLY FUELING AN UNMANNED SURFACE VEHICLE

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

BACKGROUND

A major limitation of surface vessels such as unmanned surface vehicles (USVs) is endurance, which is the ability to stay operational for extended periods without refueling or recharging. Nearly all unmanned surface vehicles rely on fossil-fueled internal combustion engines to provide power for propulsion and mission payloads. Fuel capacity for many known USVs is in the range of 400 to 800 gallons. As a result, USV mission endurance ranges from several hours to several days depending on the specific mission parameters.

Although USV endurance can be improved through design and engineering by increasing fuel density and operational efficiency, USVs still need to physically connect to a station or platform, to refuel, recharge, and transfer data. However, refueling and recharging stations are often not readily available, which creates challenges for USV designers and tactical planners regarding power requirements and energy storage.

Currently, USVs must transit from their area of operations to a safe port or to a docked host vessel for refueling. The host vessel must retrieve the USV from the sea and launch the USV after refueling. This transit, launch, and recovery time for fueling limits substantive mission time for the USV. Moreover, because of the power requirements and energy storage limitations of the USV, the host vessel must remain relatively close to the USV.

USV fueling missions also restrict the host vessel's ability to maneuver and conduct other missions, including launching or recovering other USVs. Most host vessels can only launch or recover one USV at a time. Therefore, a queue has to be created to fuel multiple USVs. This reduces USV mission time and effectiveness. Furthermore, while the host vessel is refueling USVs, other mission related sensors or weapons may be inoperable, leaving the vessel open to attack. These mission and vessel limits that result from USV refueling can be further exacerbated by sea and weather conditions, which put both the USV and host vessel at risk. During rough sea and weather conditions, USVs must transit to a safe port instead of refueling at the host vessel to conduct missions.

Accordingly, there is a need to have the ability to fuel or recharge a USV at sea away from the host ship with little or no personnel. This invention fulfills this need by providing an autonomous dockside fueling system for unmanned surface vehicles.

SUMMARY

The invention is a system and apparatus for autonomously fueling a surface water vessel, such as an unmanned surface vessel (USV) comprising a dock-side fueling station, an actuated hose-capturing device mounted to the USV, and a fuel tank interface mounted on a USV fuel receptacle for securing the fuel hose nozzle to a set refueling point on the USV.

The dock-side fueling station comprises a hose reel, a hose pusher and a mooring whip, all secured to the dock. The nozzle end of the fuel hose is suspended over water by the mooring whip with rollers. The hose pusher and hose reel lower and raise the hose over the USV for fueling.

The USV actuated hose-capturing device comprises an actuator and a hose-capturing arm attached to and extending from the actuator. The hose-capturing arm comprises a pivot section attached rotatably to the actuator, a main section attached, at an angle, to the pivot section at a pivot point, and a hose capture section attached to and extending horizontally from the main section.

The hose capture section of the hose capturing arm comprises, a whisker sensor for sensing the fueling hose, an induction sensor for sensing a ferrous metal disc section of the nozzle on the fueling hose, a bolt lock for securing the fueling hose in place in the hose capture section of the hose capturing arm, and electromagnets for holding and maintaining a ferrous metal disc section of a nozzle on the fuel hose.

The fuel tank interface comprises a mounting plate, a nozzle interface on the mounting plate, a spring-loaded flapper valve for sealing the fuel tank, and electromagnets on the mounting plate to positively locate the hose nozzle, pull and hold the nozzle in the fuel tank through the nozzle interface.

When the USV approaches the fueling station, the automated hose pusher, facilitated by rollers on the mooring whip, pushes the fuel hose through the end of the mooring whip so that the fuel hose extends downward to the water to be captured by the hose-capturing device of the USV. On the USV, the actuator on the hose-capturing device extends and rotates the hose-capturing arm to an open position, past the gunwale of the USV, to capture the fuel hose in the hose capture section of the hose-capturing arm. When the fuel hose passes into the capture section of the hose-capturing arm, a whisker sensor on the hose capture section comes in contact with the fuel hose, which indicates that the fuel hose has been captured. When the fuel hose fully passes into the capture section of the hose-capturing arm, the bolt lock engages and the whisker swings closed, preventing the fuel hose from escaping the hose-capturing arm. Next, the hose reel reels in the fuel hose until an induction sensor on the hose capture section of the hose-capturing arm senses the ferrous metal disc section of the nozzle on the hose. Then, electromagnets on either side of the hose capture section power on, securing the ferrous metal disc section of the nozzle.

Upon securing the hose nozzle, the actuated hose-capturing arm rotates back to its initial state, moving the nozzle into fueling position centered over the fuel tank mounting plate. The electromagnets on the capture section power off and the electromagnets on the fuel tank mounting plate power on to pull the nozzle through the nozzle interface and spring-loaded flapper valve readying the system to fuel the USV.

When fueling is complete, the electromagnets of the fuel tank mounting plate disengage, the nozzle releases, and the full process is reversed, allowing the fuel hose to retract from the USV using the hose reel and mooring whip in preparation for the next fueling.

This system and apparatus allows the full utilization of unmanned surface vehicles eliminating the need for them to be dispatched to a host platform or ship for refueling. Thus, the USV requires very limited, if any, human interaction throughout the performance of a mission.

DRAWINGS

DETAILED DESCRIPTION

Figure 1:
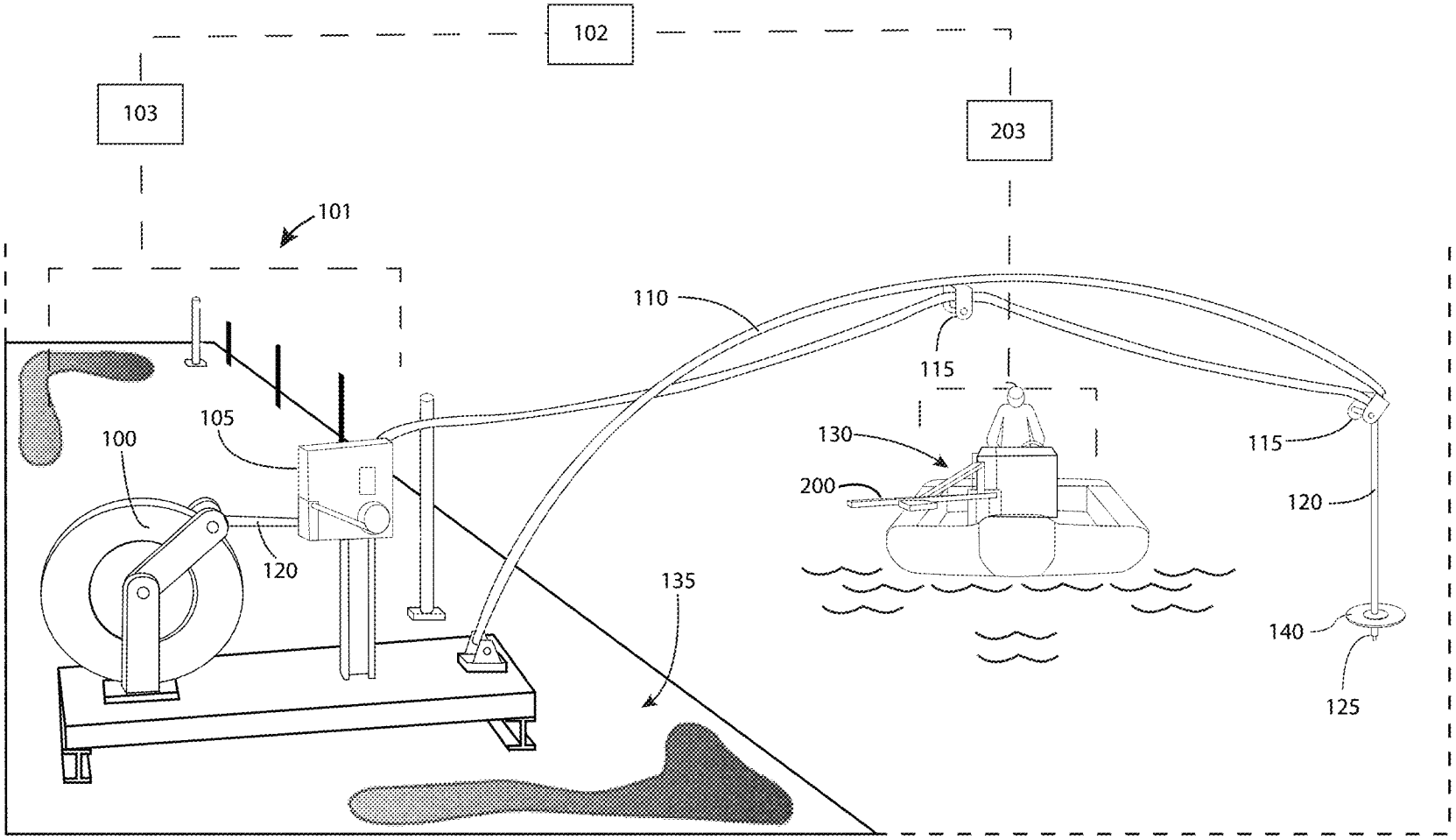
FIG. 1 shows a dockside view of the fueling station and approaching USV with a readied hose-capturing device onboard.

FIG. 1 illustrates a system and apparatus for autonomously fueling a surface water vessel, such as an unmanned surface vessel (USV). As shown, FIG. 1 is a depiction of the dockside, waterborne fueling station 101 and an approaching surface water vessel 130. The surface water vessel 130 may be manned or unmanned. According to an embodiment of the invention, the surface water vessel is an unmanned surface vehicle (USV). The fueling station 101 comprises a hose reel 100, a hose pusher 105 and a mooring whip 110 secured to a dock 135. It should be understood that as opposed to the dock 135, according to another embodiment, the fueling station 101 may be secured to floating platform or a parent vessel to provide mid-ocean service and maintenance.

Returning to FIG. 1, as shown, a fuel hose 120 is wound through the hose reel 100 and hose pusher 105 then suspended from and supported by the mooring whip 110 with rollers 115. The rollers 115 are spaced along the length of the mooring whip 110 including a roller at the end of the mooring whip 110. The rollers 115 hold and facilitate lowering and raising the fuel hose 120. The end of the fuel hose 120 has a nozzle 125, which includes a ferrous metal disc section 140 to engage with the fuel tank of the surface water vessel 130.

The hose pusher 105 pushes the hose through the rollers 115 on the mooring whip to lower the fuel hose 120 toward the surface water vessel 130 to be captured by a hose-capturing device 200 on the water vessel 130 as it approaches the fuel station for fueling. When fueling is complete, the nozzle 125 disengages from the fuel tank and the hose reel 100 retracts the fuel hose 120 from the water vessel 130 and reels it up toward the end of the mooring whip 110 in preparation for the next fueling. FIG. 1 also shows the water vessel 130 having a hose-capturing device 200, which as outlined below, captures and positions the fuel hose 120 into the fuel tank of the vessel 130 to enable fueling.

As shown schematically in FIG. 1, the system and apparatus for autonomously fueling a surface water vessel 130, may include a system controller 102, and sub controllers 103 and 203. The sub controller 103 is associated with the fueling station 101 and controls the operation of the fueling station elements, such as the hose pusher 105 and the mooring whip 110, etc. The sub controller 203 is associated with the surface water vessel 130, and controls the operation of the hose-capturing device 200, as well as other vessel related technology. The system controller 102 controls the overall operation of the system and apparatus for autonomously fueling the surface water vessel 130 based on system requirements and sensor feedback, and ensures that sub controllers 103 and 203 operate in a collaborative and coordinated manner. Controllers 102, 103, and 203 may comprise of known technology.

Figures 2A, 2C:
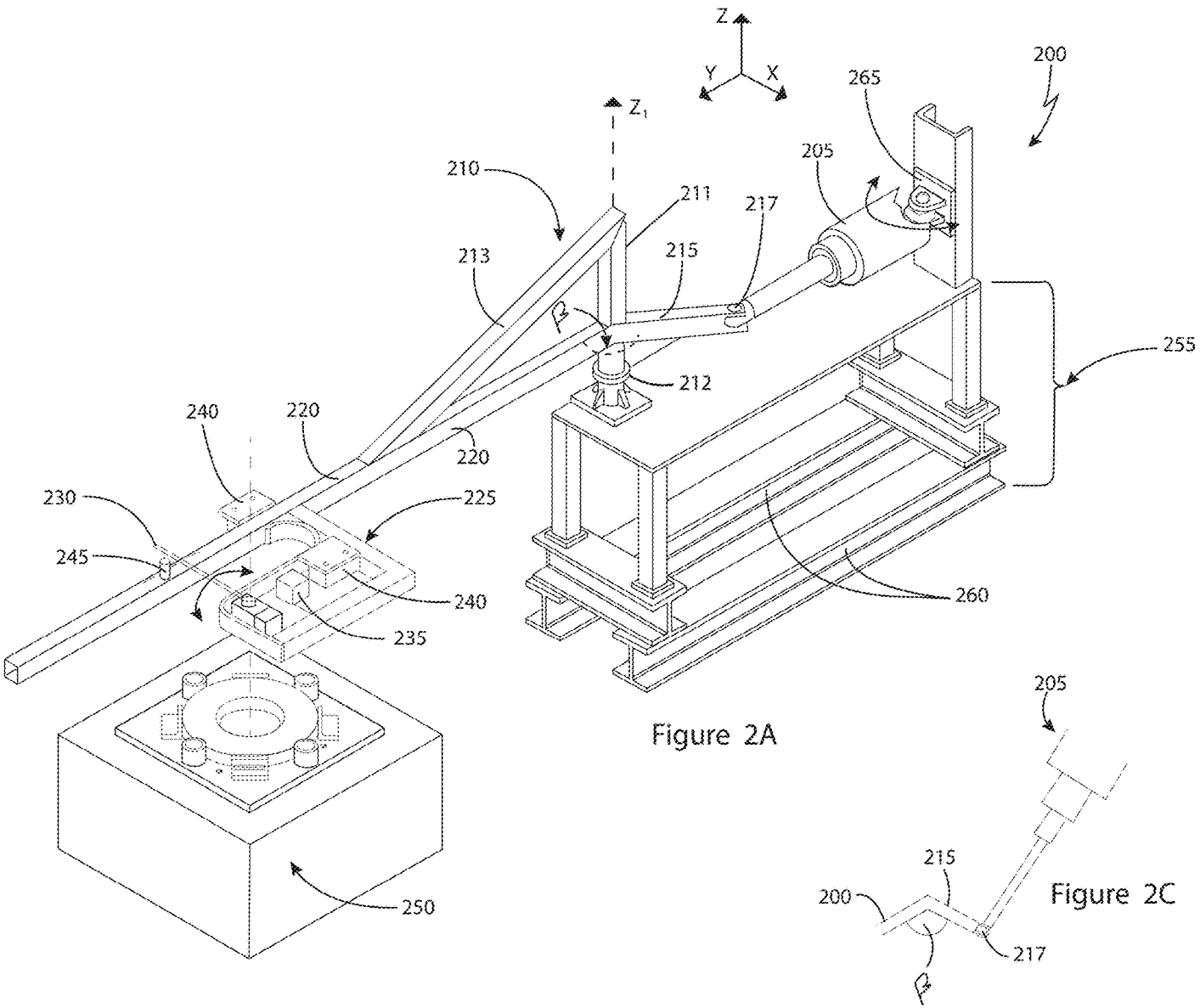
FIG. 2A shows the hose-capturing device in the closed position over the fuel tank for refueling.
FIG. 2C is a top perspective view of the linkage between the actuator and the arm assembly, showing the angular relationships between the elements.
Figure 2B:
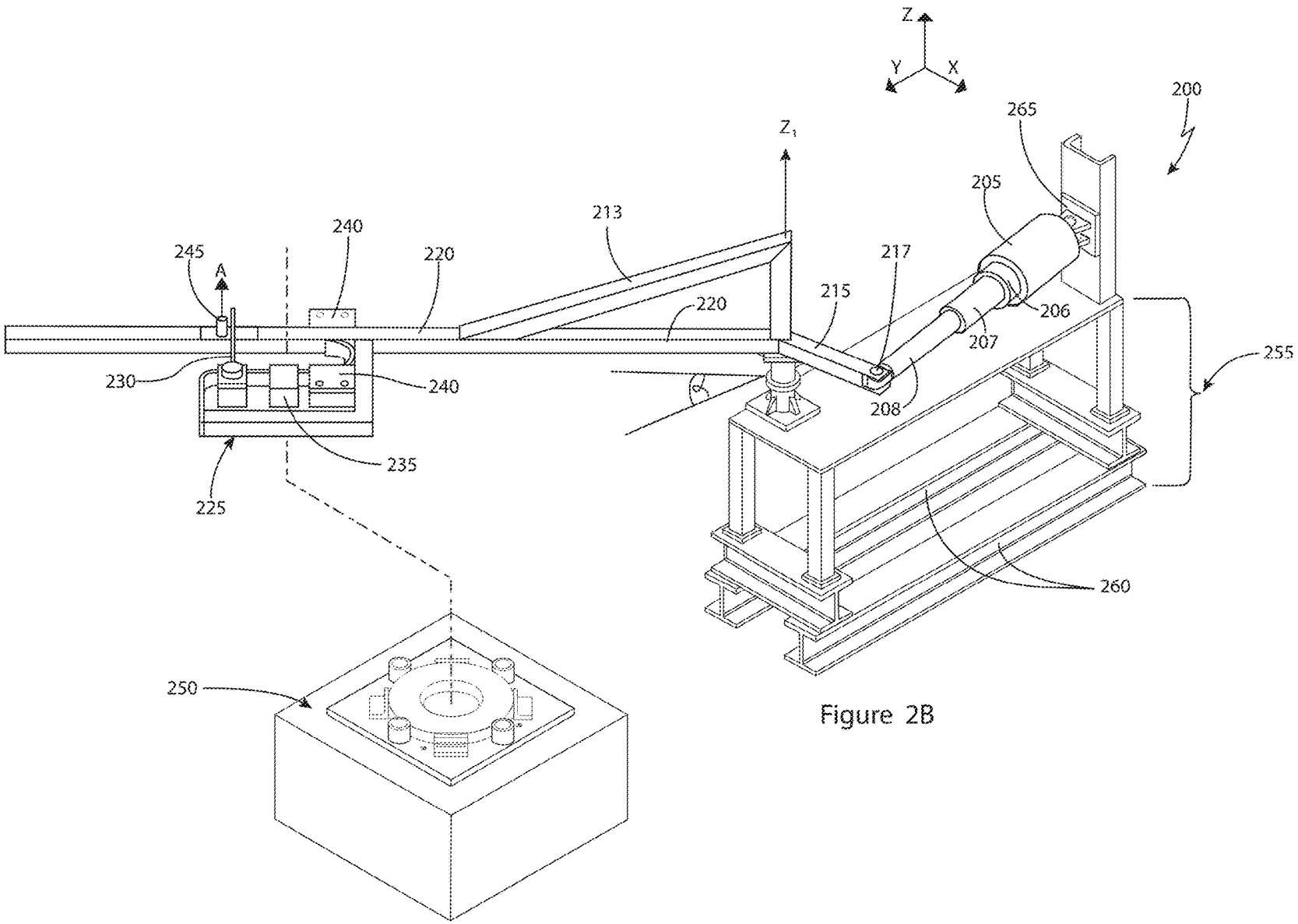
FIG. 2B shows the hose-capturing device in an open position for capturing and reeling in a fuel hose.

FIGS. 2A and 2B show the preferred embodiments of the hose-capturing device 200 in its closed and open positions respectively. The closed position is maintained while the USV is conducting a mission at sea. The open position is used to capture the fuel hose. FIGS. 2A and 2B show the hose-capturing device 200 having a hose capturing arm assembly 210. As shown in FIG. 2A, the hose capturing arm assembly 210 includes an upright arm 211 extending generally in the Z-direction, an elongated arm 220 extending generally in the X-direction and an inclined arm 213 the XZ-plane. It should be understood that the above-outlined triangular arrangement of 211, 213, and 220, provides structural stability, but other known arrangements for stabilization may be used. The hose capturing arm assembly 210 also includes a pivot arm 215. As outlined below, the hose capturing arm assembly 210 is rotatable about the $Z_1$ axis at point 212, and as outlined below, the rotation about $Z_1$ is dependent upon the stroke of the cylinder 205. From the illustration in FIG. 2A to the illustration in FIG. 2B, the hose capturing arm assembly 210 is rotated in the XY-plane, from the closed position to the open position, by an angle $\alpha$. By this rotation, the elongated arm 220 extends out over the side of the water vessel 130 to capture the fuel hose 120 hanging from the mooring whip 110 near the water. According to an embodiment of the invention, angle $\alpha$ may be about 60 degrees to about 90 degrees. It should be understood that according to some embodiments, angle $\alpha$ may be less than 60 degrees or more than 90 degrees, depending on the arrangement within water vessel 130, and according to what is required to extend the arm over the gunwale of the water vessel 130.

The hose-capturing device 200 has an actuator 205, which may be a hydraulic device or the like. As shown in FIG. 2B, the actuator may include one or more extendable and retractable sections (206, 207, 208) that extend and retract. The hose capturing arm assembly 210 attaches to the actuator 205 via the pivot arm 215 via a pin 217 or the like. The connection at the pin 217 allows for pivoting between the pivot arm 215 and the actuator 205. FIG. 2C is an exemplary top view of the actuator 205 and the hose capturing arm assembly 210 showing the angular arrangement between these elements.

FIG. 2C shows the pivot arm 215 attached to the elongated arm 220 at a fixed angle $\beta$. FIG. 2C also shows the pivot arm 215 attached to the actuator section 208 via the pin 17, at an angle $\theta$, which is adjustable based on the extending and retracting of the actuator sections (206, 207, 208). Therefore, as the actuator sections (206, 207, 208) linearly moves forward as shown by the arrow, the pivot arm 215 rotates about the pin 217, while translating forward, which rotates the arm assembly 210 about the $Z_1$-axis at the non-translatable pivot point 212. As a result, the elongated arm 220 of the hose capturing arm assembly 210 moves from the closed position shown in FIG. 2A, and extends out over the side of the surface water vessel 130 to capture the fuel hose 120, as shown in FIG. 2B.

At a distal end of the elongated arm 220 of the hose capturing arm assembly 210, away from the actuator 205, is the hose capture section 225. This section is used to capture the fuel hose 120 when the hose capturing arm assembly 210 is in the open position shown in FIG. 2B. The hose capture section 225 of the assembly 210 has a whisker sensor 230 for sensing the hose 120, and an induction sensor 235 for detecting the ferrous metal disc section 140 of the nozzle 125 of the fuel hose 120. The hose capture section 225 also includes a bolt lock 245 for limiting the rotation of the whisker sensor 230 to prevent the escape of the fuel hose 120, and electromagnets 240 for capturing and holding the ferrous metal disc section 140 of the hose nozzle 125 in place to engage with the fuel tank 250 of the surface water vessel 130. As stated above, according to an embodiment of the invention, the surface water vessel is an unmanned surface vehicle (USV).

As stated above, in operation, as the water vessel 130 approaches the fueling station 100, the actuator 205 rotates the hose capturing arm assembly 210 to the open position shown in FIG. 2B. In operation, the whisker sensor 230 senses the fuel hose 120, through contact with the hose 120, and deflection caused by this contact. In response, the whisker sensor 230 sends a signal to sub controller 203. The sub controller 203 sends a signal to power the bolt lock 245, pushing the bolt lock upwards, in the direction shown by arrow A. In this upward/engaged position, the bolt lock 245 secures the fuel hose 120 in place in the hose capture section 225 as outlined below. De-energizing causes the lock 245 to go back down in the opposite direction to release the hose.

Figure 2D:
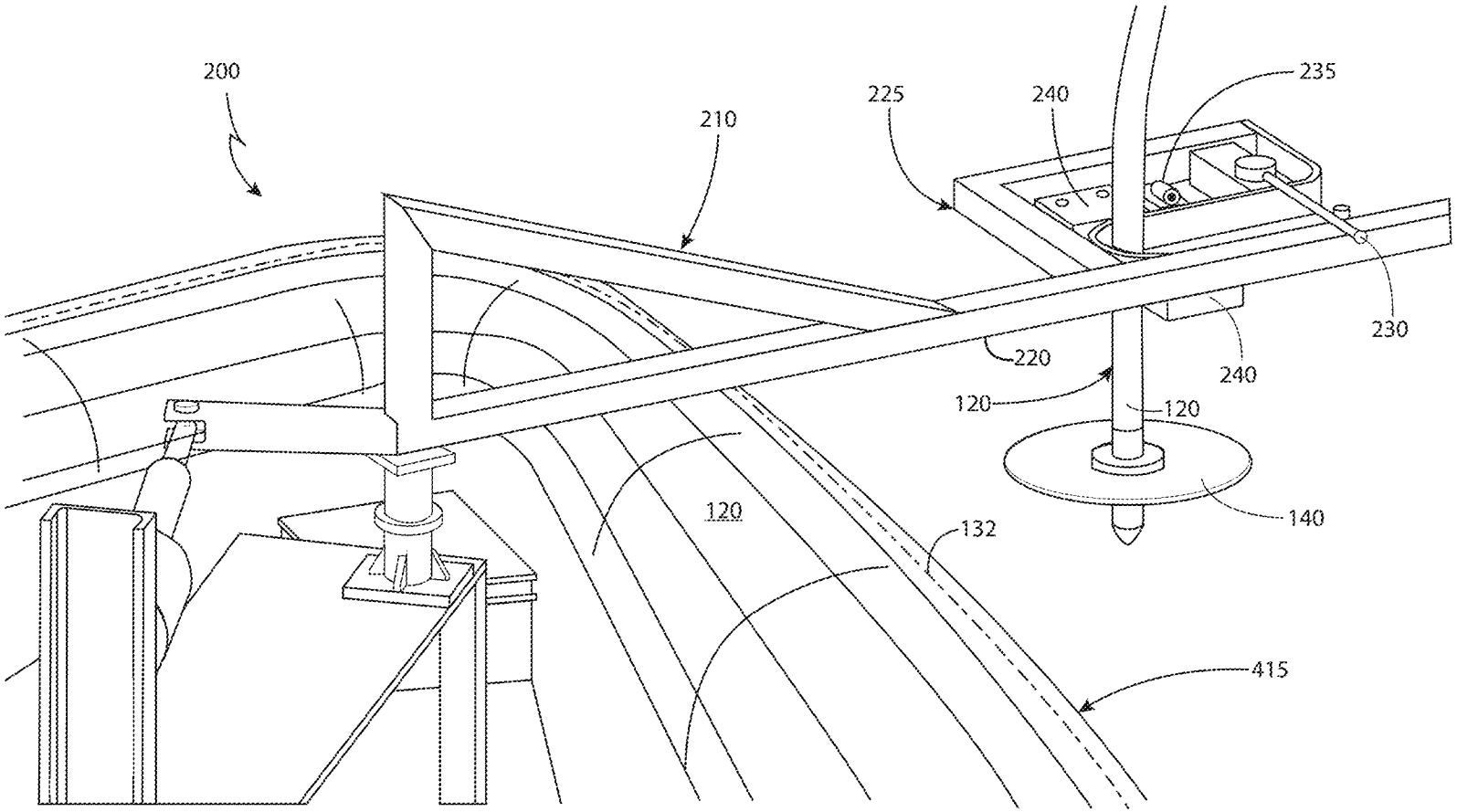
FIG. 2D shows a surface water vessel with a hose-capturing device in its open position capturing a fuel hose.

As outlined below, FIG. 2D shows the hose 120 within the hose capture sections 225. The dockside hose reel 100 starts to retract the fuel hose 120 so that the nozzle 125 of the fuel hose 120 moves upward toward the hose capture section 225 of the hose capturing arm 210. When the ferrous metal disc section 140 of the hose nozzle 125 contacts the hose capture section 225, it is detected by the metal induction sensor 235, which sends a signal to a hose-side sub controller 103, which stops the fuel hose 120 from reeling in. Coordinated by the system controller 102, the sub controller 203 sends a signal to power the electromagnets 240 to secure the fuel hose in place in the hose capture section 225. The hose-capturing arm 210 then returns to its closed position over the fuel tank 250 as shown in FIG. 2A.

Figure 2E:
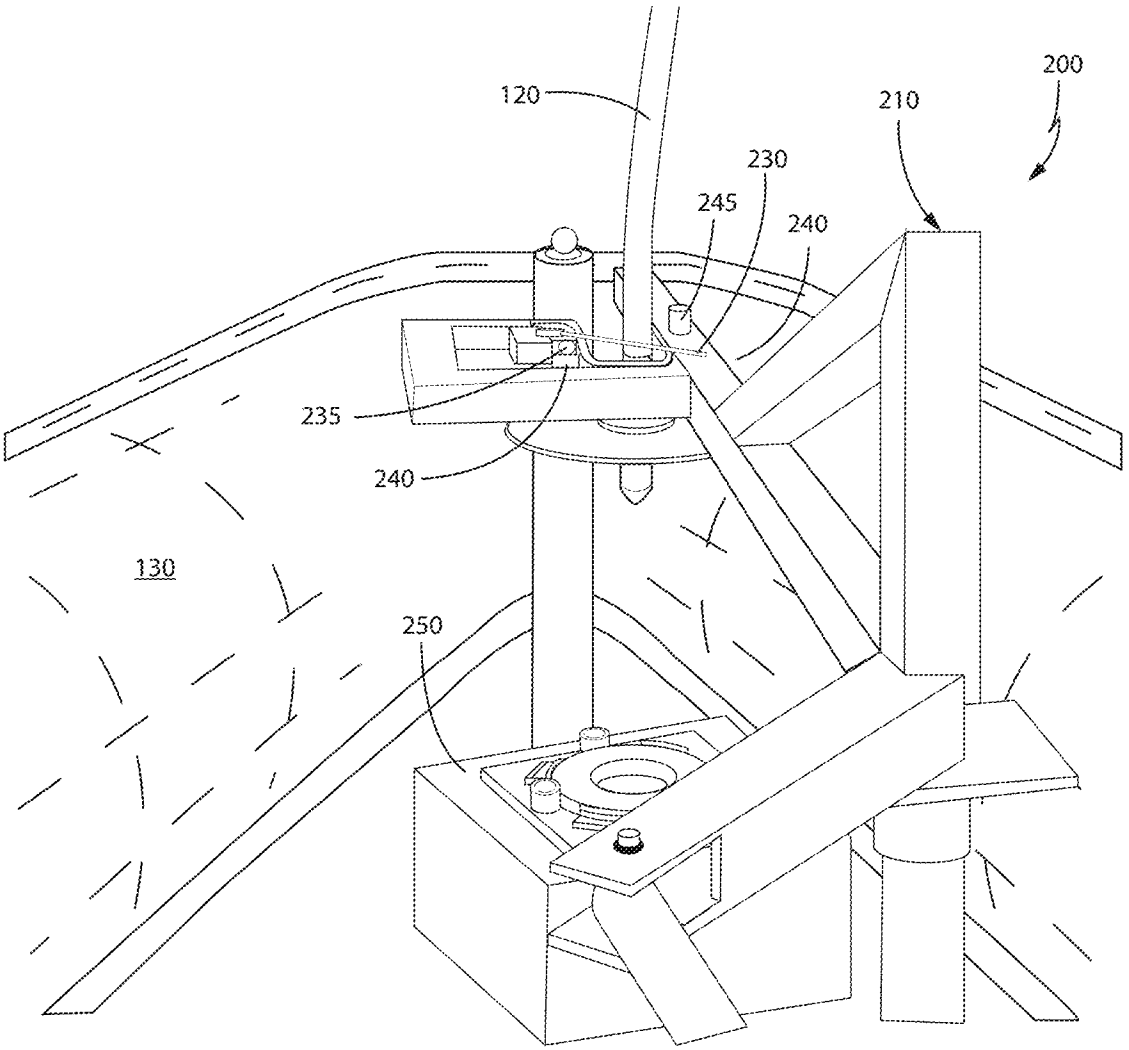
FIG. 2E shows a surface water vessel with a hose-capturing device in its closed position with a captured fuel hose preparing to fuel the surface water vessel.

FIG. 2D shows the hose-capturing device 200, with the hose capturing arm assembly 210 in its open position, capturing the fuel hose 120. As shown, the hose 120 is within the hose capture section 225. The hose 120 is positioned within a U-shaped opening of the hose capture section 225, with the whisker 230 extending across the open end of the U-shaped opening. FIG. 2D also shows the surface water vessel 130, with the elongated arm 220 of arm assembly 210, extending over the gunwale 132 of the water vessel 130. FIG. 2E shows the hose-capturing device 200, with the hose capturing arm assembly 210 in the closed position over the fuel tank 250. This is the position of the hose 120 after a fueling cycle is completed, but it is also the position before being lowered into the tank for another fueling cycle.

Figure 3:
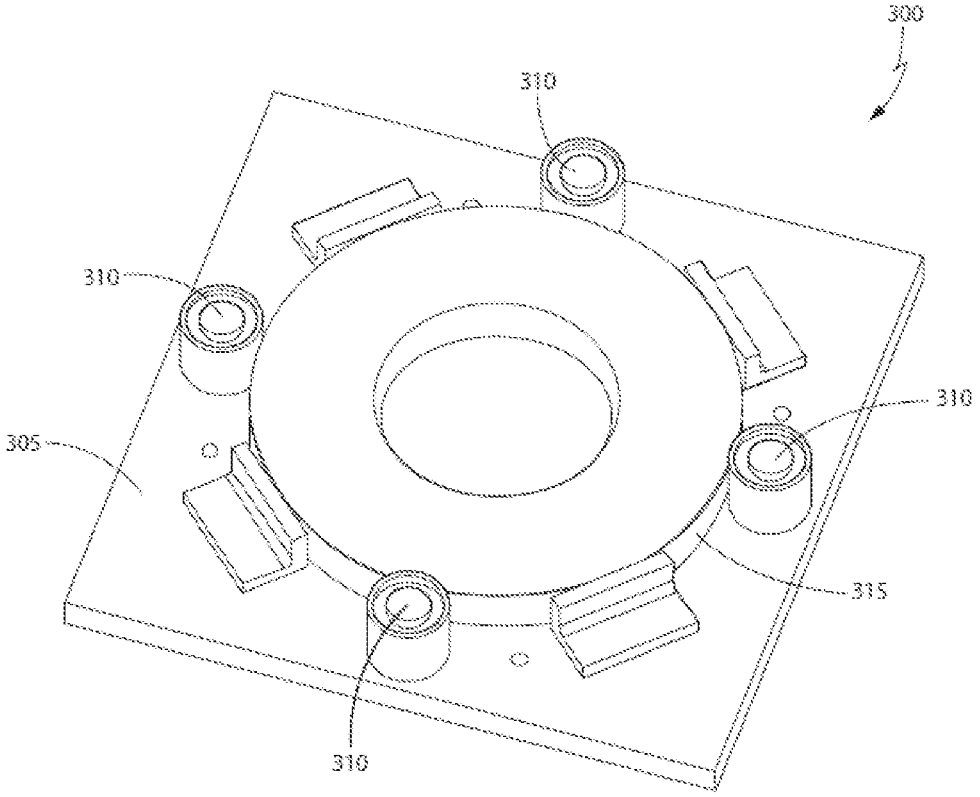
FIG. 3 shows the fuel tank interface.

FIG. 3 is a diagram of the fuel tank interface 300. The fuel tank interface 300 mounts to the surface of the fuel tank over the fuel tank opening and facilitates insertion of the fuel hose nozzle 125 into the fuel tank 250. The fuel tank interface 300 includes a mounting plate 305, interface electromagnets 310 and a spring-loaded flapper valve 315. In operation, when the nozzle 125 contacts the spring-loaded flapper valve 315, a metal disk of the flapper opens downward inward to the fuel tank providing access to the inside of the tank.

When the hose capturing arm assembly 210 returns to its closed position with the nozzle 125 of the fuel hose 120 secured in the hose capture section 225 of the hose capturing arm assembly 210 over the fuel tank interface 300, the electromagnets 240 on the hose capture section 225 power-off, which releases the nozzle 125 from the hose capturing arm assembly 210. The nozzle 125 then descends into the tank interface, through the spring-loaded flapper valve 315 and is held in place by electromagnets 310. When proper insertion of the nozzle 125 is detected, fuel is pumped, allowing fuel to flow into the fuel tank.

Once fueling is complete, the system reverses the capture process. The electromagnets 310 release the hose nozzle 125, the fuel hose 120 is retracted from the fuel tank by the hose reel 100 and the fuel hose nozzle 125 is detected and secured in the hose capture section 225 of the hose capturing arm assembly 210. The assembly 210 then rotates to its open position shown in FIG. 2B, and the hose 120 is released and further retracted by the hose reel 100 in preparation for the next fueling.

The hose-capturing device 200 can be installed and mounted on the USV in a number of ways. As shown in the preferred embodiment shown in FIG. 2A and FIG. 2B, the hose-capturing device (200) can be equipped with a table structure (255) using I-beams (260) to lift the hose-capturing device (200) and allow the arm (210) to rotate over the gunwale (132) of the water vessel unobstructed. The actuator 205 is attached to the table structure with a clevis 265. The I-beams 260 of the table structure 255 are strapped to the deck of the USV via D-rings. Alternatively, the entire table structure 255 can be built into the side or mounted into the deck of the water vessel 130.

Additionally, during the fueling process the mooring whip 110 compensates for sea turbulence. Most of the fueling process takes place on the craft-side of the system on board the USV. The hose-side/fueling station of the system is simple and can be deployed in various environments with little to no adaptation.

Although the invention has been described in detail with particular reference to preferred embodiments, other embodiments can achieve the same results. Variations and modifications of the present invention will be obvious to those skilled in the art and it is intended to cover, in the appended claims, all such modification and equivalents. The entire disclosure and all references, applications, patents and publications cited above are hereby incorporated by reference.

What is claimed is:

1. A system for autonomously fueling a surface water vessel having a fuel tank comprising:

a fueling station comprising:

a hose reel;

a hose pusher for pushing the hose;

a mooring whip;

a hose having a nozzle with a ferrous metal disc, the hose wound through the hose reel and the hose pusher and suspended over water from the mooring whip;

a hose-capturing device attached to the surface water vessel for capturing the hose suspended from the mooring whip, the hose-capturing device comprising:

an actuator;

a hose capturing arm assembly comprising;

a pivot arm, an elongated arm, and a hose capture section attached to the elongated arm, the hose capture section comprising:

a whisker sensor for sensing the hose;

an induction sensor for sensing the ferrous metal disc section of the nozzle on the hose;

a bolt lock for securing the hose in place in the hose capture section; and electromagnets for holding the nozzle in place within the hose capture section, and wherein the actuator is connected to the pivot arm for pivoting the hose capturing arm assembly about a pivot point, between an open position for capturing and reeling in the hose, and a closed position over the fuel tank for fueling the surface water vessel.

2. The system of claim 1, wherein the system includes a fuel tank interface comprising:

a mounting plate;

a nozzle interface on the mounting plate;

a spring-loaded flapper valve for sealing the fuel tank; and interface electromagnets, wherein when the nozzle descends into the tank interface, through the spring-loaded flapper valve, the interface electromagnets hold the nozzle in place in the tank to pump fuel through the nozzle into the fuel tank, and when fueling in completed, the interface electromagnets release the nozzle, and the hose reel retracts the fuel hose from the tank, then the nozzle is detected and secured in the hose capture section of the hose capturing arm assembly.

3. The system of claim 2, wherein the hose-capturing device is attached to and supported by a table structure that elevates the hose-capturing device so that the elongated arm of the hose capturing arm assembly can clear a gunwale of the surface water vessel as the hose capturing arm moves between the open position to capture the hose and the closed position to fuel the surface water vessel.

* * * * *